US005141416A

United States Patent [19]

Cognevich et al.

[11] Patent Number: 5,141,416

[45] Date of Patent: Aug. 25, 1992

[54] PLUNGER FOR A DOWNHOLE RECIPROCATING OIL WELL PUMP AND THE METHOD OF MANUFACTURE THEREOF

[75] Inventors: Michael L. Cognevich, Tulsa; Shannon B. Sixkiller, Broken Arrow, both of Okla.

[73] Assignee: Dover Resources, Inc., New York, N.Y.

[21] Appl. No.: 656,246

[22] Filed: Feb. 14, 1991

[51] Int. Cl.[5] ..... F04B 21/04

[52] U.S. Cl. ..... 417/554; 417/DIG. 1; 92/222; 92/248; 427/292

[58] Field of Search ..... 92/212, 222, 248; 417/554, DIG. 1; 29/888.04, 888.042, 888.044, 888.048; 427/292, 355, 398.1, 423

[56] References Cited

U.S. PATENT DOCUMENTS

| | | | |
|---|---|---|---|
| 1,741,643 | 12/1929 | McClure | 92/248 |
| 3,332,753 | 7/1967 | Batchelor et al. | 427/292 |
| 3,595,101 | 7/1971 | Cooper | 74/596 |
| 3,817,732 | 6/1974 | Pei | 65/33 |
| 3,829,243 | 8/1974 | Carbonnel et al. | 417/50 |
| 4,091,970 | 5/1978 | Komiyama et al. | 222/596 |
| 4,135.861 | 1/1979 | Brown et al. | 417/183 |
| 4,338,360 | 7/1982 | Cavanagh et al. | 427/292 |
| 4,516,479 | 5/1985 | Vadasz | 417/DIG. 1 |
| 4,600,599 | 7/1986 | Wallstén | 427/292 |
| 4,652,218 | 3/1987 | Tsutsui et al. | 417/368 |
| 4.671.740 | 6/1987 | Ormiston et al. | 416/241 |
| 4,744,738 | 5/1988 | Miki et al. | 418/126 |
| 4,768,923 | 9/1988 | Baker | 415/170 |
| 4,779,876 | 10/1988 | Novosad | 277/81 |
| 4,789,507 | 12/1988 | Wesley | 264/29 |
| 4,806,078 | 2/1989 | Heumann | 416/186 |
| 4,806,080 | 2/1989 | Mizobuchi et al. | 417/353 |
| 4,834,625 | 5/1989 | Grant | 417/413 |
| 4,850,818 | 7/1989 | Kotera | 417/366 |
| 4,874,300 | 10/1989 | Laing et al. | 411/420 |
| 4,883,116 | 11/1989 | Seidenberg et al. | 165/104 |
| 4,910,174 | 3/1990 | Bert et al. | 501/105 |
| 4,911,609 | 3/1990 | Anderson et al. | 415/174 |
| 4,913,619 | 4/1990 | Haentjens et al. | 415/172 |

*Primary Examiner*—Richard A. Bertsch
*Assistant Examiner*—Charles G. Freay
*Attorney, Agent, or Firm*—Head & Johnson

[57] ABSTRACT

A method of manufacturing a plunger for a downhole reciprocating oil well pump for use in sandy environments including the step of machining a metal plunger to the required base configuration with an external cylindrical pump surface having a diameter of about 0.025 inches less than the design diameter, grit blasting the plunger cylindrical pump surface to achieve a textured surface thereon, heating the plunger, flame spraying a thin layer of ceramic composite on the plunger cylindrical pump surface, repeating the flame spraying steps sequentially until the diameter of the cylindrical pump surface having the ceramic composite thereon is about 0.015 to 0.020 inches above the design diameter, cooling the plunger and grinding the ceramic covered plunger pump surface to the design diameter.

10 Claims, 1 Drawing Sheet

PLUNGER FOR A DOWNHOLE RECIPROCATING OIL WELL PUMP AND THE METHOD OF MANUFACTURE THEREOF

BACKGROUND OF THE INVENTION

When an oil well is drilled a string of casing is positioned in the well borehole extending from the earth's surface to the producing formation. In many instances when a borehole penetrates an oil bearing formation, bottomhole pressure of the formation is sufficient to cause crude oil to flow from the formation to the earth's surface. In many parts of the world, however, the bottomhole pressure is not substantial or long lasting, and when the pressure drops to that which is insufficient to force crude oil to the earth's surface some means must be provided for pumping the well. For this reason, reciprocating bottomhole pumps have been employed from the beginning of the petroleum industry.

In the typical oil well pumping arrangement, a pump jack is positioned at the earth's surface that reciprocates a long string of sucker rods within a tubing string. A bottomhole pump is positioned within the tubing string. The typical bottomhole pump includes a stationary barrel affixed to or removably attached to the tubing. Positioned within the stationary barrel is a reciprocating plunger affixed to the lower end of the sucker rod string. A standing or stationary valve, usually in the form of a ball and seat, is typically affixed to the lower end of the barrel and a traveling valve is secured to the plunger, the traveling valve also typically being a ball and seat.

In this arrangement, on the upstroke of the sucker rod string the plunger is pulled upwardly within the barrel, closing the traveling valve and drawing fluid within the barrel through the open standing valve. On the downstroke of the plunger the standing valve closes and fluid within the plunger passes upwardly through the traveling valve, through the interior of the plunger and out above the plunger. On the succeeding upstroke the fluid above the plunger is forced upwardly, past the upper end of the barrel into the interior of the tubing and ultimately to the earth's surface. The valves support the entire weight of the fluid column from the pump to the earth's surface, and, therefore, the typical reciprocated bottomhole pump must, according to the depth of the pump, withstand considerable fluid pressures.

The efficiency and effectiveness of the pump depends upon a very close fit between the exterior plunger pump surface and the barrel interior cylindrical surface. When fluid leakage occurs between these surfaces efficiency of the pump is reduced and if substantial fluid flow occurs between the exterior plunger surface and the interior barrel surface, the pump can become totally defective. The problem of pumping crude oil is that in some locations substantial components of sand or other abrasives are entrained within the crude oil fluid. Most oil producing formations are of relatively high porosity and are formed of compacted sand granules, and some of the sand granules become dislodged from the formation as the fluid is extracted from it. Abrasives also originate from scale, mineral deposits and other sources. Since most reciprocating downhole pumps are made of metal, that is, a metal barrel and a metal plunger, there is metal to metal contact as the plunger is reciprocated within the barrel. If sand is entrained within the crude oil fluid, the abrasive effect can soon wear a pump plunger to the point where the well efficiency drops below an acceptable level.

In addition to the arrangement hereinabove described of a stationary barrel and a reciprocating plunger, in some instances this relationship is reversed, providing a stationary plunger and a reciprocating barrel. In addition, the valving arrangements for bottomhole pumps can be varied considerably. However, a common characteristic of reciprocating bottomhole pumps is that in order to move fluid from an oil bearing formation to the earth's surface, a plunger and a barrel must be reciprocated relative to each other.

An object of this invention is to provide an improved pump plunger having longer wearing characteristics and one that is especially adaptable for use in sandy environments.

SUMMARY OF THE INVENTION

This invention provides an improved plunger for a reciprocating pump and a method of manufacturing a plunger for a reciprocal oil well pump and particularly, a method of manufacturing a plunger that has increased resistance to the abrasive effect of sand entrained in liquids being pumped. The first step in manufacturing a plunger according to this invention is to machine a metal plunger to the required base configuration with an external cylindrical pump surface having a diameter of about 0.025 inches less than the design diameter. By "design diameter" is meant the ultimately desired diameter to match the diameter of the internal cylindrical surface of the pump barrel with which the plunger is to be used.

After the plunger cylindrical pump surface has been prepared with a reduced external diameter, the cylindrical pump barrel surface is grit blasted to achieve a uniform textured surface thereon.

The plunger is then heated and a flame spray of bond coat is applied on the plunger cylindrical pump surface to a thickness of about 0.003 inches to about 0.006 inches. This bond coat should have a bond strength of at least about 4500 psi, and such bond strength can be achieved using an exothermic nickel-aluminide flame spray powder.

After the bond coat is applied a thin layer of ceramic composite is flamed sprayed onto the plunger cylindrical pump surface. The layer of flame spray ceramic composite on the plunger pump surface should be very thin, that is, about 0.0005 inches to 0.002 inches per pass. The ceramic composite may be, as by example, flame spray applied alumina titania of about 87% $Al_2O_3$ plus about 13% $TiO_2$.

The step of flame spraying a thin layer of ceramic composite on the plunger cylindrical surface is repeated sequentially until the diameter of the plunger cylindrical pump surface having the ceramic composite thereon is about 0.015 to 0.020 inches above the design diameter.

Thereafter, the plunger is allowed to cool to ambient temperature and the ceramic covered plunger surface is ground to the design diameter, that is, to the diameter required to closely fit within a pump barrel internal cylindrical surface.

The finished grinding must be accomplished to a fine smooth surface texture and heavy cuts and chatter must be avoided. If the pump to which the plunger to be used is for a highly corrosive environment, it is preferable that the ceramic coated plunger cylindrical pump surface be coated with a penetrating sealer.

After the layer of ceramic composite has been formed onto the plunger and the plunger finished to the design diameter, it must be carefully handled so as to avoid excessive flexing or impact to the ceramic surface to thereby avoid the possibility of cracking the ceramic surface.

The completed plunger is then ready for installation in a bottomhole pump and particularly, a bottomhole pump for use in sandy environments.

A better understanding of the invention will be had by reference to the following description and claims, taken in conjunction with the attached drawings.

DESCRIPTION OF THE PREFERRED EMBODIMENTS

Figure 1:
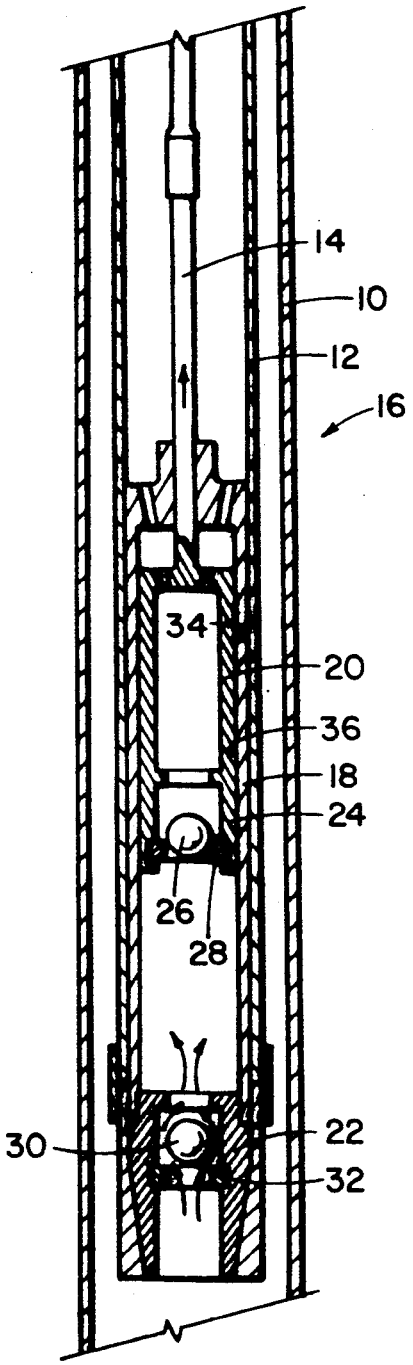
FIG. 1 is a diagrammatic illustration of a typical bottomhole pump showing the environment in which a plunger manufactured by the method of this disclosure is employed.

Referring first to FIG. 1, the environment in which a plunger for a bottomhole reciprocating oil well pump is employed is illustrated. A string of casing 10 extends from the earth's surface and serves to line a borehole formed in the earth from the surface to a producing formation. Within casing 10 is a string of tubing 12 that extends from the earth's surface and forms a conduit for conveyance of pumped fluid. Within the tubing is a string of sucker rods 14 that are reciprocated by a pumping unit at the earth's surface (not shown). Crude oil, typically combined with formation water, is pumped within tubing string 12 to the earth's surface. The vertical reciprocation of sucker rod string 14 furnishes energy to the bottomhole pump. The bottomhole pump is generally indicated by the numeral 16 and can be said to include four basic elements, that is, a pump barrel 18; a pump plunger 20; a stationary or standing valve 22 affixed to the lower end of barrel 18; and a traveling valve 24 affixed to the plunger 20. Plunger 20 is affixed to the lower end of sucker rod string 14 and is reciprocated within barrel 18.

The pump illustrated in FIG. 1 is typical and can be arranged in many forms. In some instances the barrel is reciprocated and the plunger is stationary. However, in order to move fluid from a deep downhole formation to the earth's surface within a string of tubing 12 the usual means is by the reciprocal relationship between a plunger and a pump barrel.

FIG. 1 illustrates sucker rod string 14 on the upstroke as indicated by the arrow. In this condition the traveling valve 24 is closed, that is, a ball 26 within the traveling valve rests on valve seat 28. Fluid within pump 16 and within tubing 12 is moved upwardly by the upward displacement of plunger 20, and this upward movement on each upstroke of the pump results in the translation of the fluid within the producing formation to the earth's surface.

In the upstroke, as seen in FIG. 1, standing valve 22 is open as fluid flows therethrough, drawn upward by the upwardly moving plunger 20. The standing valve has a ball 30 that is unseated as fluid flows therepast through a seat 32. On the downstroke of plunger 20 the attitudes of traveling valve 24 and standing valve 22 are reversed, that is, on the plunger downstroke ball 30 moves against seat 32 and traveling valve ball 26 moves off of seat 28, permitting fluid to flow therepast.

The effectiveness and efficiency of the pump of FIG. 1 is dependent on two basic requirements, that is, first a tight and substantially leak proof fit between the external plunger cylindrical pump surface 34 and the barrel internal cylindrical pump surface 36. The second requirement for efficiency of the pump is the effectiveness of the traveling valve 24 and standing valve 22 to fully close when required according to pump action.

Barrel 18 and plunger 20 are typically formed of high grade metals, including steel and steel alloys to achieve maximum life as is economically feasible to provide. When the fluid being pumped, that is, crude oil typically with water admixed therewith and in which the fluid is not highly corrosive or that does not have substantial amounts of sand entrained therewith, metal plungers have a relatively long useful life. On the other hand, when the pump of FIG. 1 is required to pump fluid having amounts of sand entrained therewith, wear on the plunger external cylindrical pump surface can occur at a rapid rate. When the plunger pump surface wears excessively, permitting fluid to flow therepast as the plunger is reciprocated, the efficiency of the pump can drop to the point where the pump must be replaced. To replace plunger 20 requires the pump to be pulled from the well which, in turn, means that sucker rod string 14 must be pulled. This is a time consuming and therefore an expensive endeavor, and for this reason it is highly desirable that pump plungers be formed to have a life expediency as long as it is economically feasible to produce.

Figure 2:
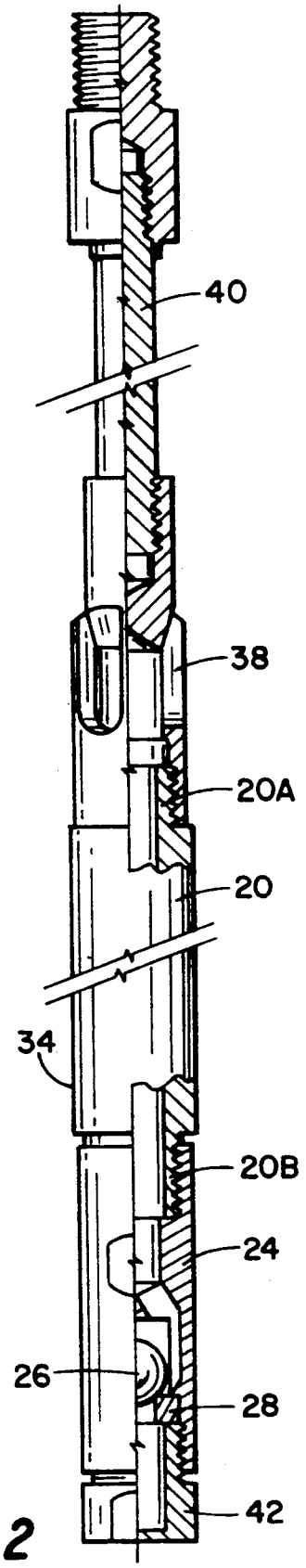
FIG. 2 is a more detailed illustration of a typical plunger of the type manufactured by the method of this disclosure as would be employed in a downhole pump as illustrated in FIG. 1.

FIG. 2 shows more details of a typical pump plunger, generally indicated by the numeral 20. The plunger 20 of FIG. 2 has an integral reduced external diameter threaded portion 20A at the upper end thereof that receives a top plunger cage 38 that is, in turn, affixed to the sucker rod string 14 of FIG. 1.

In FIG. 2 traveling valve 24 is in the form of a closed plunger cage that is threaded onto a lower reduced diameter integral threaded portion 20B of the plunger. The valve seat 28 is held in position within plunger cage 24 by means of a seat plug 42.

The construction of the typical plunger of FIG. 2 is shown by example, and it can be seen that the critcal portion of the plunger is the external cylindrical surface 34 since it is this surface that contacts the barrel internal cylindrical surface to cause pumping action as the plunger is reciprocated. The object of this invention is to provide a plunger 20 with an external cylindrical surface 34 that is highly resistant to wear, particularly in sandy and abrasive environments.

The plunger 20 is manufactured in the following manner. The basic configuration of plunger 20 is machined of high grade metal, such as high grade steel, with the integral reduced diameter portions 20A and 20B at the ends thereof. The plunger cylindrical pump surface 34 is provided with or machined to have a base configuration having a diameter of about 0.025 inches less than the design diameter to match the internal diameter 36 of pump barrel 18 with which the plunger is to be used.

The external cylindrical pump surface of metal plunger 20 is then grit blasted to achieve a textured surface thereon.

Plunger 20 is then heated or preheated and a layer of bond coat is flame sprayed onto the plunger cylindrical pump surface. The bond coat is preferably formed by use of exothermic nickel-aluminide flame spray powder and sprayed to form a bond coat layer having a thickness of about 0.003 to 0.006 inches. The bond coat preferably has a tensile bond strength of at least 4500 psi. While other products may be acceptable, a bond coat that has proven successful is EUTECTIC SUPER ULTRABOND 50000 as sold by Eutectic Corporation of Flushing, N.Y.

After the bond coat has been flame sprayed to the required depth onto the plunger external cylindrical pump surface, thin layers of ceramic composite are sequentially applied to the plunger cylindrical pump surface. This is achieved by flame spraying in very thin layers ceramic composite onto the pump surface. Preferably the flame sprayed composite is applied in layers of about 0.0005 inches to 0.002 inches. The flame sprayed layers ae sequentially repeated until the diameter of the plunger external cylindrical pump surface exceeds the design diameter by about 0.015 inches to about 0.020 inches. Flame spray is preferably accomplished using an acetylene-oxygen mixture.

The preferred ceramic composite for use in flame spray application is alumina titania formed of about 87% $Al_2O_3$ plus 13% $TiO_2$. A flame sprayed ceramic composite powder that has functioned successfully for this application is sold by Eutectic Corporation of Flushing, N.Y., under their trademark designation "METACERAM 250030."

After the layer of ceramic composite has been built up on the plunger cylindrical surface by flame spraying as described to a thickness such that the diameter exceeds the design diameter by about 0.015 inches to 0.020 inches, the plunger is permitted to cool to ambient temperature. Thereafter the plunger cylindrical pump surface is ground to the design diameter. This step requires the grinding to the finished size to be accomplished in a manner to achieve the desired smooth surface texture. Since the surface texture must be very smooth to reduce wear against the barrel internal cylindrical pump surface with which the plunger is used, the surface must have a fine texture. In grinding the plunger heavy cuts and chatter must be avoided.

If the plunger is to be used in a pump subjected to corrosive environments, that is, is to be used in an oil well in which the fluid to be pumped is corrosive, the plunger cylindrical pumping surface may be rubbed with a penetrating sealer.

After the plunger has been prepared following the sequence of steps above described it must be carefully handled. Excessive flexing of the plunger must be avoided and impact of the plunger external cylindrical pump surface against a heavy object must also be avoided since either of such action could result in cracking the flame spray applied ceramic layer on the plunger pump surface.

Pump plungers manufactured according to the above described methods have been tested. One such pump plunger was installed in a pump in a well having sandy conditions and functioned for over two months, which was twice as long as the previously used metal plungers. The main reasons for the extended service life achieved to plungers manufactured according to the above method is that the ceramic coated plungers tend to polish itself smooth as it wears, as opposed to metal plungers that tend to become rougher and prone to scoring as they wear. A second advantage is that ceramic coated plungers made according to the above methods have a surface that has a slight porosity that tends to retain oil. Thus, the ceramic coated plunger tends to be self lubicating.

The above methods have the advantages that the flame spray application of the ceramic composite can be accomplished at only about 600° F. This, relatively low temperature, prevents annealing of the plunger base metallic material and avoids the reduction of strength and hardness that is encountered when manufacturing methods at higher temperatures are employed.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such termes used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A method of manufacturing a plunger for a downhole reciprocal oil well pump, comprising the steps of:

(a) machining a metal plunger to required base configuration with an external cylindrical pump surface having a diameter of about 0.025 inches less than the design diameter to match the internal diameter of the pump barrel in which the plunger is to be used;

(b) grit blasting the plunger cylindrical pump surface to achieve a textured surface thereon;

(c) preheating the plunger;

(d) flame spraying a thin layer of ceramic composite on the plunger cylindrical pump surface;

(e) repeating step (d) sequentially until the diameter of the plunger cylincrical surface having the ceramic composite thereon is about 0.015 to 0.020 inches above the design diameter;

(f) cooling the plunger having the ceramic composite thereon to about ambient temperature; and (g) grinding the ceramic covered plunger cylindrical pump surface to the design diamater.

2. A method of manufacturing a pump plunger according to claim 1 including:

sealing the ceramic coated plunger cylindrical pump surface with a penetrating sealer.

3. A method of manufacturing a pump plunger according to claim 1 wherein in step (d) the ceramic composite is about 87% $Al_2O_3$ and 13% $TiO_2$.

4. A method of manufacturing a pump plunger according to claim 1 which in step (d) flame spraying is accomplished using an acetylene-oxygen flame.

5. A method of manufacturing a pump plunger according to claim 1 wherein step (d) includes first flame spraying a bond coat on the plunger cylindrical pump surface to a thickness of about 0.003 to 0.006 inches.

6. A method of manufacturing a pump plunger according to claim 5 wherein the bond strength of the bond coat is at least about 4500 psi.

7. A method of manufacturing a pump plunger according to claim 5 wherein the bond coat is formed by use of exothermic nickel-aluminide flame spray powder.

8. For use in a downhole pump for pumping fluids, such as crude oil with or without water admixed therewith, through a tubing string extending from the earth's surface, the pump having a barrel having fluid communication at its upper end to a tubing string and with a subterranean source of fluid, the barrel having an internal cylindrical pumping surface and valves for controlling the flow of fluid unidirectionally upwardly through the barrel, an improved plunger reciprocally positioned in said barrel comprising:

an elongated metal cylindrical plunger having an external cylindrical pumping surface in sliding engagement with the barrel internal cylindrical pumping surface, the plunger cylindrical pump being in the form of a plurality of layers of ceramic composite of about 87% $Al_2O_3$ and 13% $TiO_2$.

9. An improved plunger for a downhole pump according to claim 8 wherein said plunger cylindrical pumping surface has a coating of penetrating sealer tnereon.

10. An improved plunger for a downhole pump according to claim 8 wherein said plunger cylindrical pumping surface is in the form of a plurality of layers of ceramic composite, each layer being of thickness of about 0.003 to 0.006 inches.

* * * * *